US008801336B2

(12) United States Patent
Steyn

(10) Patent No.: US 8,801,336 B2
(45) Date of Patent: Aug. 12, 2014

(54) ROCK BOLT

(71) Applicant: Johann Steyn, Germiston (ZA)

(72) Inventor: Johann Steyn, Germiston (ZA)

(73) Assignee: RSC Mining (Pty) Ltd., Germiston (ZA)

( * ) Notice: Subject to any disclaimer, the term of this patent is extended or adjusted under 35 U.S.C. 154(b) by 0 days.

(21) Appl. No.: 13/706,693

(22) Filed: Dec. 6, 2012

(65) Prior Publication Data

US 2013/0149042 A1 Jun. 13, 2013

(30) Foreign Application Priority Data

Dec. 7, 2011 (ZA) ..... 2011/08969

(51) Int. Cl.
*E21D 21/00* (2006.01)

(52) U.S. Cl.
CPC ..... *E21D 21/0033* (2013.01)
USPC ..... 405/259.1; 405/259.2

(58) Field of Classification Search
USPC ..... 405/259.1–262
See application file for complete search history.

(56) References Cited

U.S. PATENT DOCUMENTS

| | | | | |
|---|---|---|---|---|
| 4,509,889 | A * | 4/1985 | Skogberg et al. | 411/19 |
| 5,791,823 | A * | 8/1998 | Blakley et al. | 405/259.1 |
| 6,056,482 | A * | 5/2000 | Calandra et al. | 405/302.2 |
| 6,322,290 | B1 * | 11/2001 | Calandra et al. | 405/259.1 |
| 6,428,243 | B1 * | 8/2002 | Hutchins | 405/259.1 |
| 6,561,721 | B2 * | 5/2003 | Lausch et al. | 403/282 |
| 6,612,783 | B2 * | 9/2003 | Stankus et al. | 405/259.5 |
| 2002/0076295 | A1 * | 6/2002 | Gibbons | 411/1 |
| 2007/0009330 | A1 * | 1/2007 | Locotos | 405/259.5 |
| 2008/0038068 | A1 * | 2/2008 | Craig | 405/259.3 |
| 2009/0074516 | A1 * | 3/2009 | Craig | 405/259.1 |
| 2010/0104377 | A1 * | 4/2010 | Campbell et al. | 405/259.5 |

* cited by examiner

*Primary Examiner* — Benjamin Fiorello
(74) *Attorney, Agent, or Firm* — Mattingly & Malur, PC

(57) ABSTRACT

A rock bolt includes an elongated tubular shank which has a defined outer diameter in which has a first end and a second end. A component is received on the first end of the elongate tubular shank and is fixed to the shank by welding. The component can be externally threaded and can be configured to be threadably engaged by a nut.

4 Claims, 2 Drawing Sheets

ROCK BOLT

CROSS-REFERENCE TO RELATED APPLICATIONS

This application corresponds to, and claims priority from South African Application No. 2011/08969 filed Dec. 7, 2011, the disclosure of which is expressly incorporated herein in its entirety.

FIELD OF THE INVENTION

This invention relates to a rock bolt.

BACKGROUND OF THE INVENTION

Rock bolts, which are made from elongate tubular shanks, are used in many applications, particularly in underground mining. In hard rock mining e.g. in gold and platinum mines in South Africa, it is often difficult to drill a borehole of reduced dimensions into a rock body. This means, in turn, that when a rock bolt is to be fixed in a borehole using grout or resin, the rock bolt must have a predetermined maximum diameter, relative to the diameter of the borehole, to ensure that the resin or grout bonding process is effectively implemented.

To allow for the rock bolt shank to have a desirable outer diameter, without using an excessive amount of material, use is made of a tubular shank. Typically one end of the shank projects from a mouth of the borehole adjacent a rock face. According to requirements, the protruding end of the shank may be threaded so that a nut can be coupled thereto. This is to allow a tensile force to be placed on the shank. A problem with this approach is that, in forming the thread, the strength of the shank is reduced.

An object of the present invention is to provide a rock bolt which, at least in one preferred embodiment, addresses the aforementioned factor.

SUMMARY OF INVENTION

The invention provides a rock bolt which includes an elongate tubular shank which has a defined outer diameter, a first end and an opposing second end. The rock bolt also includes a component with a passage through it, or into it. The first end of the shank extends into the component which is then fixed to the shank by means of welding.

In a first form of the invention the component is hexagonal i.e. in the nature of a nut. The passage in the component is not threaded and has a diameter which is substantially equal to the defined diameter of the shank.

In a second form of the invention the component is externally threaded. A nut is threadedly engaged with the component.

The second approach allows for the tubular shank to be stressed i.e. placed under a tensile force by advancing the nut along the externally threaded component.

BRIEF DESCRIPTION OF THE DRAWINGS

The invention is further described by way of examples with reference to the accompanying drawings in which.

DESCRIPTION OF PREFERRED EMBODIMENTS

Figure 1:
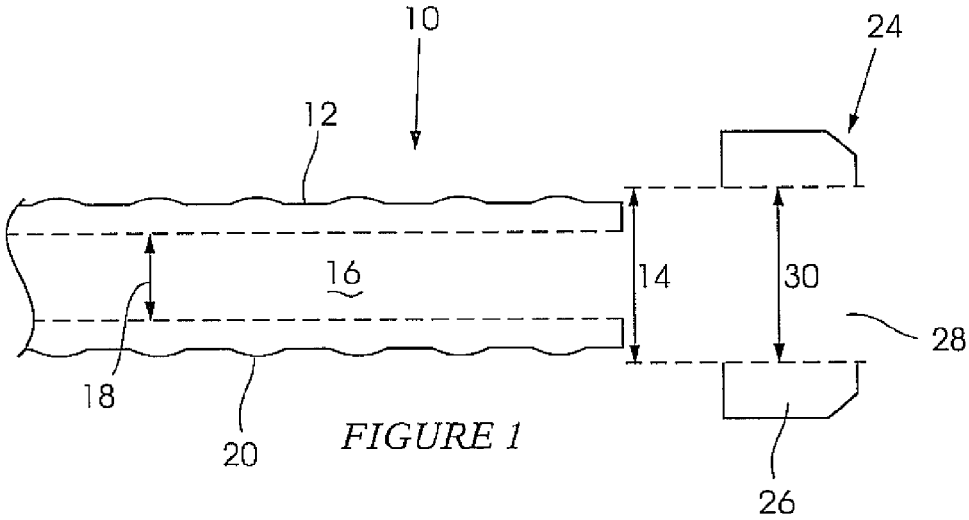
FIG. 1 is a side view in cross-section of an end of a rock bolt shank which is to be engaged with a component according to one form of the invention.

FIG. 1 of the accompanying drawings illustrates an end 10 of a rock bolt which includes an elongate tubular shank 12. The shank 12 has an outer defined diameter 14, as determined by operating requirements, and an inner bore 16 which has a diameter 18.

An external surface of the shank 12 is formed with keying formations 20 of any appropriate kind.

A component 24 is shown in FIG. 1. The component 24 comprises a body 26 which has an hexagonal external shape i.e. it is in the form of a nut. A passage 28 is formed through the body 26. The passage 28 has a diameter 30. This diameter 30 is substantially equal to the shank outer diameter 14. Internally, the passage 28 is smooth i.e. it is not threaded.

Figure 2:
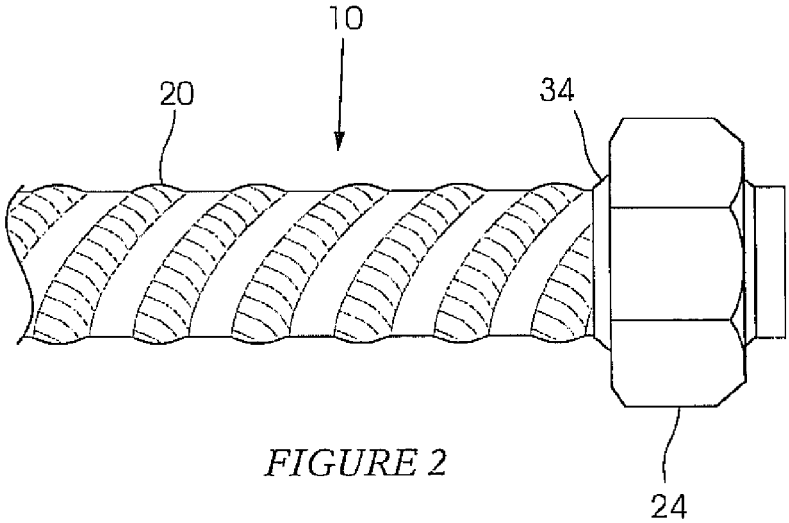
FIG. 2 shows the component engaged with the shank.

FIG. 2 shows the component 24 placed onto the end 10 of the shank 12. The body 26 of the component 24 is secured to the shank 12 by means of welding 34.

The rock bolt shank 12 shown in FIG. 2 is a so-called "fixed head" type. Rotational movement can be imparted to the shank 12 by engaging a suitable tool, not shown, with the hexagonal body 26. This allows the shank 12 to be used for mixing and dispersing a resin composition in order for the bolt shank 12 to be fixed, adhesively, in position in a borehole in a body of rock.

Figure 3:
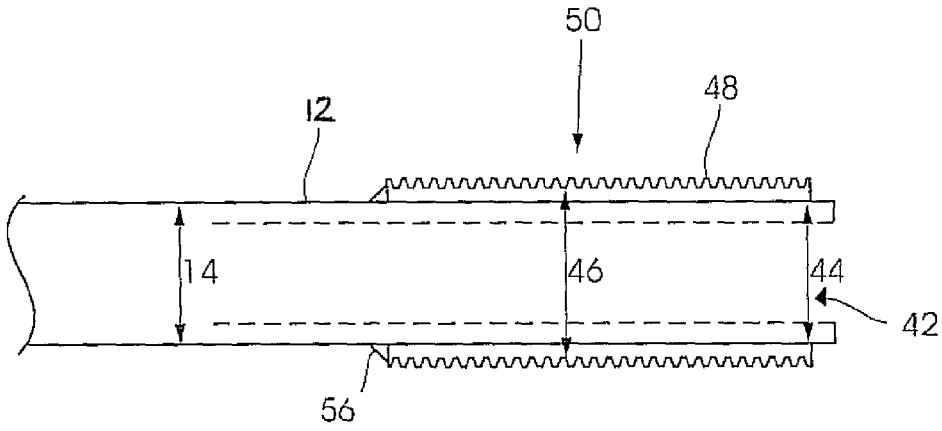
FIGS. 3 and 4 are exploded and assembled side and cross-sectional views respectively of an end of a rock bolt shank according to a second form of the invention.
Figure 4:
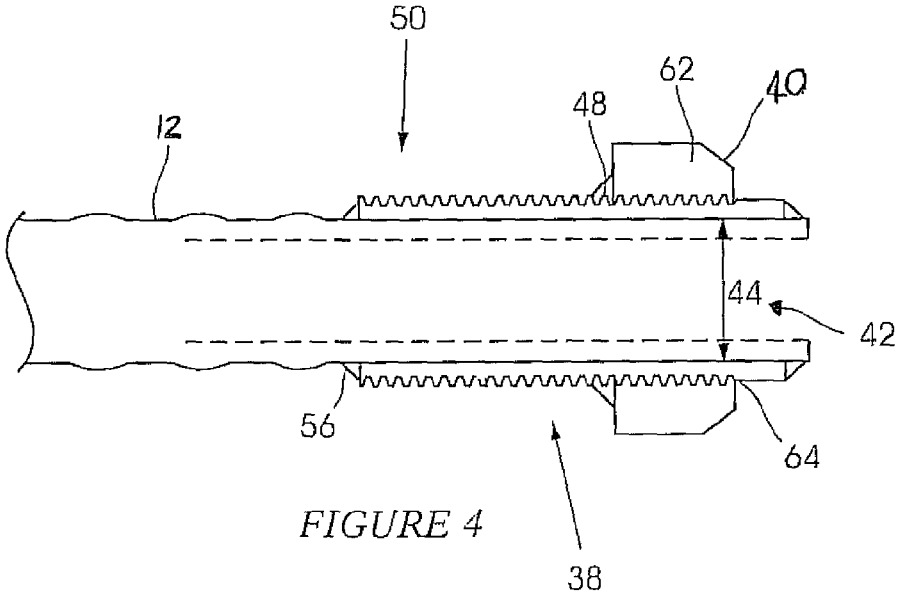

FIGS. 3 and 4 illustrate a second embodiment of the present invention, generally at 50. Use is made of a component which includes an elongate tubular member 38 and a nut 40. The elongate tubular member 38 has a body that is provided with a passage 42 with a passage diameter 44 which is substantially equal to the outer diameter 14 of a tubular shank 12. The body of the tubular member 38 has an external diameter 46 and is formed with thread formations 48 over its outer surface.

FIG. 3 illustrates an end 10 of the rock bolt shank 12. This is substantially the same as what has been described in connection with FIG. 1.

FIG. 4 shows the tubular member 38 which has been placed over the end 10 of the shank 12 and which has then been fixed to the shank 10 by means of welding 56. A nut 40 is engaged with the tubular member 38. The nut 40 comprises a hexagonal body 62 with internal threads 64 which enable the hexagonal body 62 to be threadedly engaged with the thread formations 48 of the tubular member 38.

The rock bolt shown in FIGS. 3 and 4 is of the so-called "stressed head" type. The thread 48 can be nipped or slightly deformed or treated in any other appropriate way so that, if a suitable tool is engaged with the hexagonal body 62 of the nut 40, rotational movement can then be imparted by the tool, via the head 62, to the shank 12. This feature allows for the shank 12 to be used as a mixing device to ensure that a resinous composition inside a borehole in which the shank 12 is positioned is properly mixed. Once the resin has set, the bond between the threaded member 38 and the nut 40 is broken and the nut 40 can then be advanced along the threaded member 38, typically acting against a load-spreading washer, to enable the shank 12 to be placed under a desired tensile force. Again this is achieved without reducing the strength of the shank 12 in any way.

What is claimed is:

1. A rock bolt comprising:

an elongate tubular shank which has a defined outer diameter, an external surface which has an external surface diameter less than said defined outer diameter, an inner bore with an inner diameter and which elongate tubular shank has a first end and an opposing second end;

keying formations formed on the external surface of the elongate tubular shank, said keying formations forming said defined outer diameter of said elongate tubular shank; and a component comprising a body with a defined external shape and with a component inner passage formed through said body and into which component inner passage the first end of the elongate tubular shank slidably extends, which component inner passage has a smooth component inner passage surface and has a component inner passage diameter which is substantially equal to the defined outer diameter of the tubular shank, which component is placed on an end of the external surface of the elongate tubular shank with said component inner passage surface in contact with said keying formations, is fixed to the end of the elongate tubular shank by welding of said component body to said keying formations and to said external surface of said elongate tubular shank and which component external shape is a nut with a hexagonal outer surface.

2. The rock bolt according to claim 1 wherein the component is usable to impart rotation to the elongate tubular shank through rotation of the nut.

3. A rock bolt comprising:

an elongate tubular shank which has a defined, smooth outer diameter, an external surface, an inner bore with an inner diameter and which elongate tubular shank has a first end and an opposing second end, said defined, smooth outer diameter being constant at least at said first end of said elongate tubular shank;

an elongate tubular member having a body with an outer surface and with a smooth inner passage having an inner passage diameter sized to receive said constant diameter of said first end of said elongate tubular shank and into which smooth inner passage the first end of the elongate tubular shank extends, which elongate tubular member is fixed to the constant outer diameter of the first end of the elongate tubular shank by welding;

thread formations on the outer surface of the elongate tubular member;

an internally threaded nut receivable on the thread formations on the outer surface of the elongate tubular member; and a breakable bond formed between said internally threaded nut and said thread formations on the outer surface of the elongate tubular member by treatment of said thread formations, whereby rotational movement can be imparted to said elongate tubular shank by rotation of said nut due to said bond and further wherein, upon breakage of said bond, said nut can be rotated relative to the elongate tubular member to advance said nut along said elongate tubular member.

4. The rock bolt according to claim 3 wherein the nut is advancable along the elongate tubular member to place the elongate tubular shank under a tensile force.

* * * * *